US008256367B2

(12) United States Patent
Murray et al.

(10) Patent No.: US 8,256,367 B2
(45) Date of Patent: Sep. 4, 2012

(54) ANCHOR COVER

(76) Inventors: Nicole Murray, Westport, MA (US); Kevin R. Murray, Westport, MA (US)

( * ) Notice: Subject to any disclaimer, the term of this patent is extended or adjusted under 35 U.S.C. 154(b) by 267 days.

(21) Appl. No.: 12/731,466

(22) Filed: Mar. 25, 2010

(65) Prior Publication Data

US 2012/0137953 A1 Jun. 7, 2012

Related U.S. Application Data

(60) Provisional application No. 61/163,096, filed on Mar. 25, 2009.

(51) Int. Cl.
*B63B 21/24* (2006.01)

(52) U.S. Cl. ..... 114/294

(58) Field of Classification Search ..... 114/294–311, 114/315, 321, 382, 240 R, 241, 240 A–240 E; 383/61.3; D12/317
See application file for complete search history.

(56) References Cited

U.S. PATENT DOCUMENTS

| | | | | |
|---|---|---|---|---|
| 3,339,607 | A * | 9/1967 | Howard | 206/315.1 |
| 4,928,618 | A * | 5/1990 | Kubli | 114/293 |
| 5,524,569 | A * | 6/1996 | Rich et al. | 114/294 |
| 6,055,923 | A * | 5/2000 | Militzer | 114/210 |
| 7,377,227 | B2 | 5/2008 | LaRoche | |

* cited by examiner

*Primary Examiner* — Daniel Venne
*Assistant Examiner* — Anthony Wiest
(74) *Attorney, Agent, or Firm* — Salter & Michaelson

(57) ABSTRACT

A cover for an anchor, particularly a fluke-type boat anchor is constructed of a cover material of a resilient rubber that includes an elongated section and side wings. An elongated opening and closing member, such as a zipper, enables the cover to be opened and closed for receipt of the anchor therein.

20 Claims, 22 Drawing Sheets

ANCHOR COVER

RELATED CASE

Priority for this application is hereby claimed under 35 U.S.C. §119(e) to commonly owned U.S. Provisional Patent Application No. 61/163,096 which was filed on Mar. 25, 2009 and which is incorporated by reference herein in its entirety.

TECHNICAL FIELD

The present invention relates in general to a cover for an anchor. More particularly, the present invention relates to an anchor cover that is constructed of a rubber like material such as neoprene and that is used for the purpose of providing a safe cover for an anchor. Even more particularly, the present invention pertains to an anchor cover that is usable both onboard a vessel as well as on shore.

BACKGROUND OF THE INVENTION

At the present time it is typical to anchor a boat at a shoreline with the use of an anchor such as a "fluke" boat anchor. These types of anchors, as well as other anchor constructions, provide edges or projections that present an unsafe situation. Beachgoers who are walking by present an unsafe situation. Beachgoers who are walking by, or children who are playing on the beach (sand bar, tidal flats, etc.) where boats are anchored may cause injury to their toe or foot when they accidentally stumble over this extremely pointed anchor construction. Also, the anchor is typically stored in the boat and this causes a further problem in that the anchor has sharp edges, points or projections and thus can provide an unsafe environment when it is stored. Moreover, the anchor, when mishandled, can cause damage to the boat itself. These anchors are typically made of a heavy gauge steel, with jagged, pointed, angled and sharp edges. Due to these exterior surfaces of the anchor, scratching, gouging, poking and tears of vinyl seats and fiberglass surfaces are common occurrences when moving this type of anchor in and out of the vessel.

Coverings and bras for anchors do presently exist such as shown in U.S. Pat. No. 5,524,569 to Rich et al. and U.S. Pat. No. 7,377,227 to LaRoche. However, these products are ineffective in that they do not provide a complete covering of the anchor. Moreover, these products are primarily for use only when the anchor is positioned at its usual location on the vessel.

Accordingly, it is an object of the present invention to provide a cover for an anchor, particularly for a fluke-type boat anchor. The cover of the present invention protects the anchor and, more importantly, protects any adjacent people or users from damage by engaging with or tripping over the anchor. The anchor has universal use in that it can be used both on-board a vessel, as well as on-shore.

SUMMARY OF THE INVENTION

In accordance with the present invention, there is provided a stretchable cover that is preferably constructed of a rubber-like material such as neoprene. This cover encapsulates the anchor. The cover provides a snug contoured fit over the entire anchor. A chain or rope is able to protrude from the end of the anchor cover. There is also provided a zipper on one side (back) of the cover spanning nearly 80 percent of the overall length of the anchor.

With the cover of the present invention, beachgoers who are walking by, or children who are playing on the beach (sand bar, tidal flats, etc.) where boats are anchored, will not split open their toe or foot when they accidentally stumble upon this extremely pointed anchor because of the protective cover. Also, when the anchor is lying on the floor of the boat while under way, the anchor will be covered with a protective sheath such as of neoprene, thus providing foot safety while moving around the boat. Moreover, the cover of the present invention also prevents damage to the person when walking along a beach or shoreline.

As indicated previously, these fluke-type anchors are made of heavy gauge steel with jagged, pointed, angled and sharp edges. By having a protective cover encapsulating this type of anchor, this provides protection to the interior and exterior surfaces of wood and fiberglass boats. Scratching, gouging, poking and tearing of vinyl seats and fiberglass surfaces are all common occurrences when moving this type of anchor in and out of boats, and with the cover of the present invention such damage will be eliminated.

Another advantage of the cover of the present invention is that boaters can advertise their favorite sports team, boat name, model of boat, family name, or any other saying on the top of the cover. When the anchor is embedded in the sand any logo or saying will be viewable to others. When the anchor is firmly mounted in the bow pulpit (external anchor mount on bow of boat) it will also be viewable to others while cruising or when at a marina.

These pointed fluke anchors are not the prettiest sight when they are secured on the bow of a nice sport boat, so in consideration of this, boaters can add a little fashion to the front of their boat with a snugly fit, sharp looking protective cover that is preferably of neoprene. The cover can be shiny neoprene black (like a dive suit), or match the color of the hull, or be colored to match the boat hull and canvas accents.

The anchor cover of the present invention is relatively simple in construction and includes, as indicated previously, a zipper or the like. This zipper may also be a velcro-type closure. This enables the back of the stretchable cover to unzip so that the fluke anchor can slide into the cover and retain ends of the tines. The neoprene cover may then be zipped shut. When the anchor is to be engaged into the sand, the cover can be at least partially unzipped with the flukes then rotated into position so that the flukes or tines may be engaged into the sand with the rest of the anchor being above the sand and covered with the cover of the present invention.

When the anchor is stowed, mounted or being moved from the beach into the boat, simply unzip the cover half way, fold the fluke tines flat with the anchor and then zip the cover up. The tines are now zipped inside the cover, and the whole anchor is now well padded with a snug protective cover.

In accordance with the present invention there is provided a cover for an anchor comprising a cover material of a resilient rubber material that includes an elongated section and side wings, along with an elongated opening and closing member that enables the cover to be opened and closed for receipt of an anchor therein. Other aspects of the present invention the cover material may be neoprene; the elongated section includes an elongated tapered portion and the side wings include a pair of side extending wings that are integral with the tapered portion, and that define with the elongated tapered portion an opening; the opening and closing member preferably comprises a zipper that extends longitudinally through the tapered portion; the tapered portion encloses the anchor with an end hole for receiving an end loop of the anchor; ends of a rod of the anchor are accommodated in the respective pair of side extending wings; each side extending wing has an inner protective buffer layer; the cover preferably has spaced holes to allow any water accumulated in the cover to be discharged from the cover; including a floatation piece attached to the cover; wherein the floatation piece includes a floatation ball and including a tether to attach the floatation ball to the cover; and wherein the tether is expandable.

In accordance with another aspect of the present invention there is provided a protective cover for a boat anchor that comprises a cover that is constructed of a resilient rubber or cloth material and that is arranged for receipt of at least a portion of the anchor; the cover including an elongated section and side wings; the elongated section includes an elongated tapered portion and the side wings include a pair of side extending wings that are integral with the tapered portion, and that define with the elongated tapered portion an opening; an access means including an elongated closure device that extends longitudinally of the tapered portion for receipt of the anchor therein; the elongated closure device having open and closed positions. Other aspects include wherein the elongated closure device comprises a zipper that extends longitudinally through the tapered portion; wherein the tapered portion encloses the anchor with an end hole for receiving an end loop of the anchor; wherein the anchor is a fluke-type boat anchor that includes a rod member that is accommodated in the respective pair of side extending wings; and wherein the anchor includes a pair of flukes that extend through the opening defined between the tapered portion and the side extending wings.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

There are disclosed herein a number of different embodiments of the present invention for use with anchors of different types. The primary embodiment illustrated in FIGS. 1-14 is particularly meant for use with a fluke anchor. Further modifications to this first anchor cover construction are shown in FIGS. 15-18. Another embodiment of the present invention is illustrated in FIGS. 19-23 referred to herein as an anchor vest. Lastly, in respect to FIGS. 24 and 25, an anchor cover is illustrated for use with either a "delta" anchor or a "bruce" anchor. In addition, the concepts of the present invention are anticipated as being able to cover virtually any type of an anchor construction.

Figure 2:
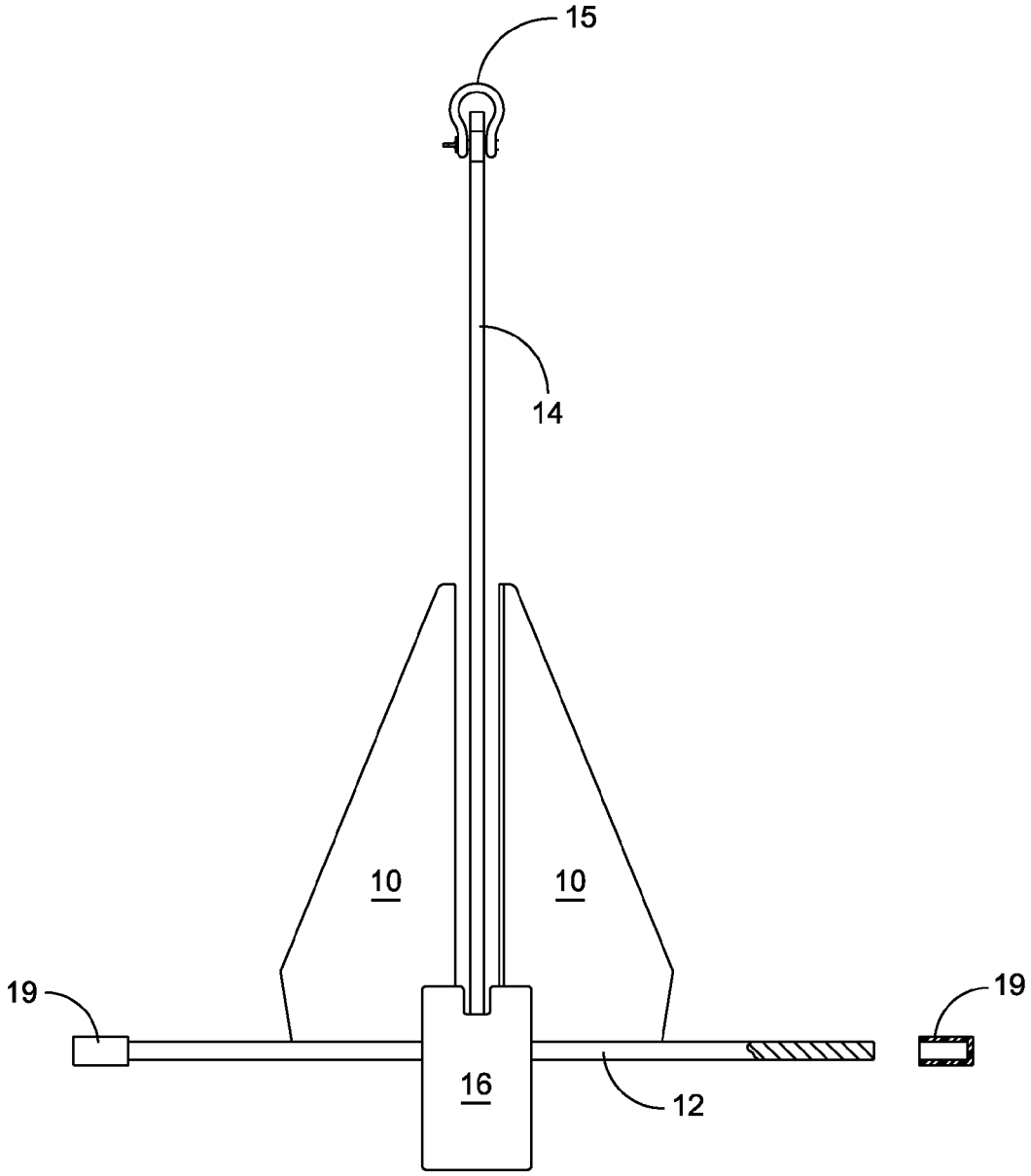
FIG. 2 is a plan view of the anchor itself.
Figure 12:
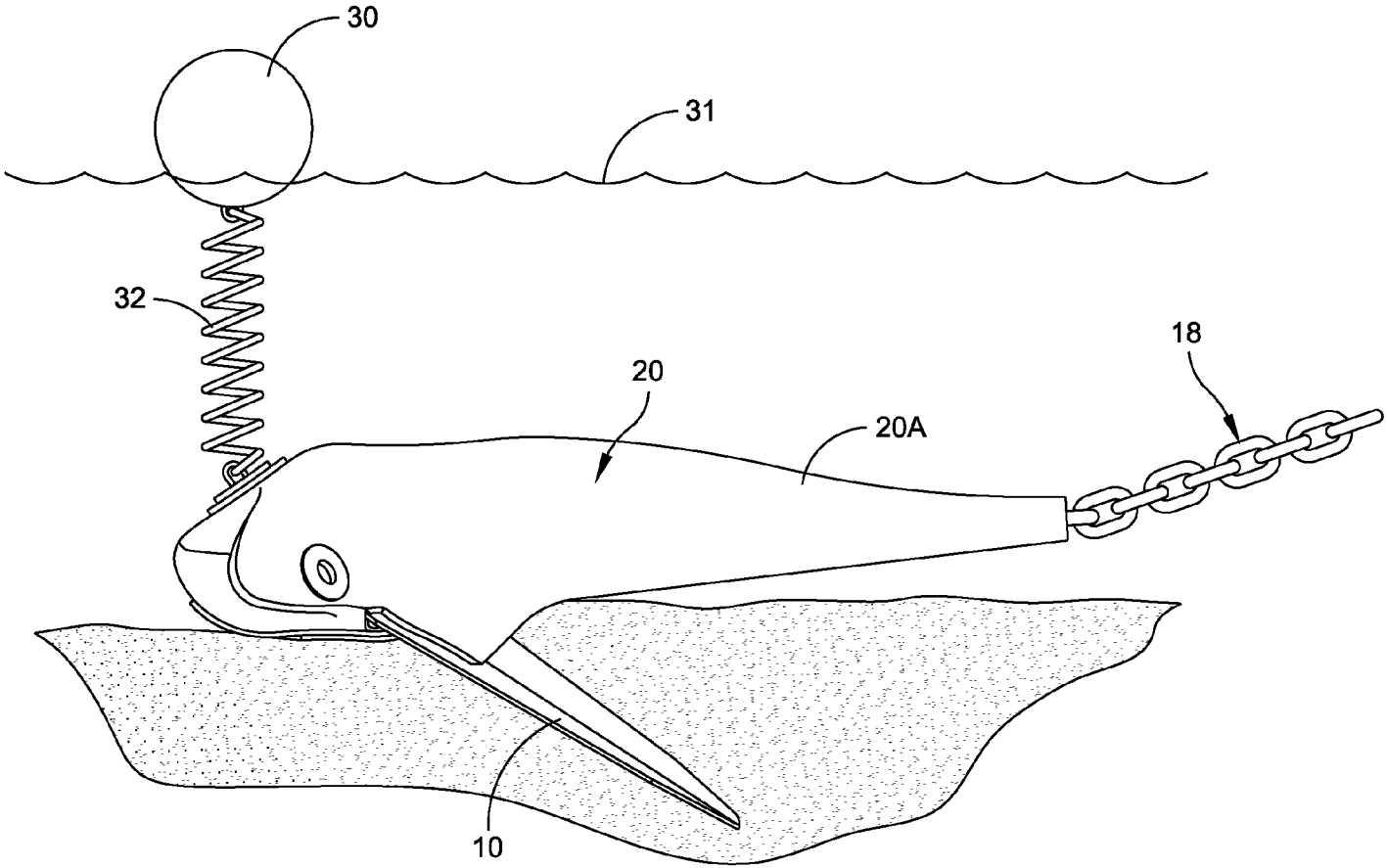
FIG. 12 is a side elevation view showing the cover on the anchor and the flukes of the anchor embedded.

Reference is now made to FIG. 2 which illustrates a conventional fluke anchor that may be considered as comprised of side disposed flukes 10 that are pivotally supported from a support rod 12. The support rod 12 is connected with the elongated arm 14 by means of an attachment plate 16. The fluke anchor that is illustrated in the drawings may be considered of conventional design and usually includes two relatively large flat fluke members. These are hinged so that they can be oriented at different angles. This enables a burying of the flukes in the sand or other ground material such as is illustrated in FIG. 12 herein. A chain 18 is typically attached to the arm 14 at the end loop 15. A pair of end caps 19 may be provided on each end of the rod 12 as illustrated in FIG. 2.

Figure 1:
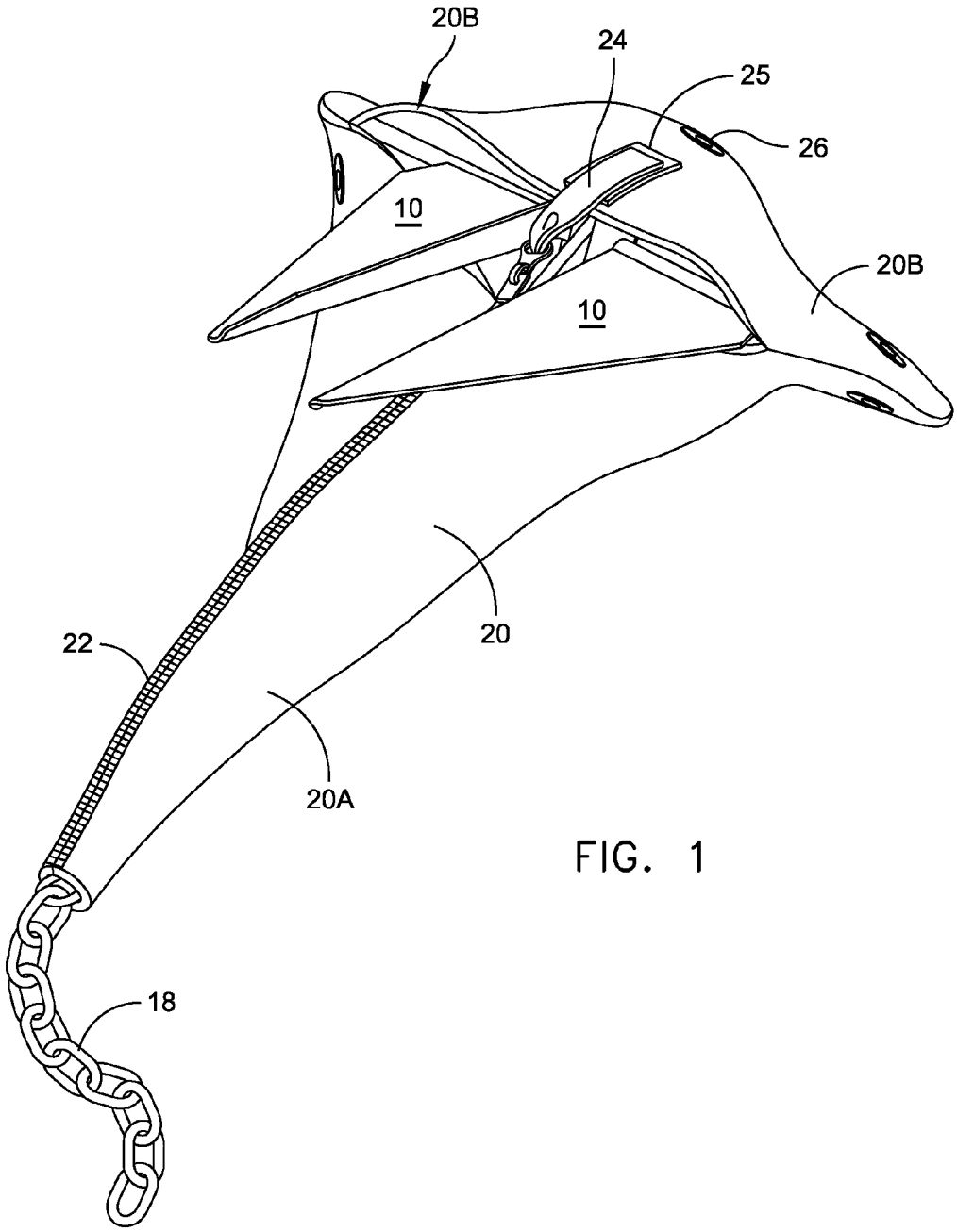
FIG. 1 is a perspective view of the anchor cover of the present invention.
Figure 14:
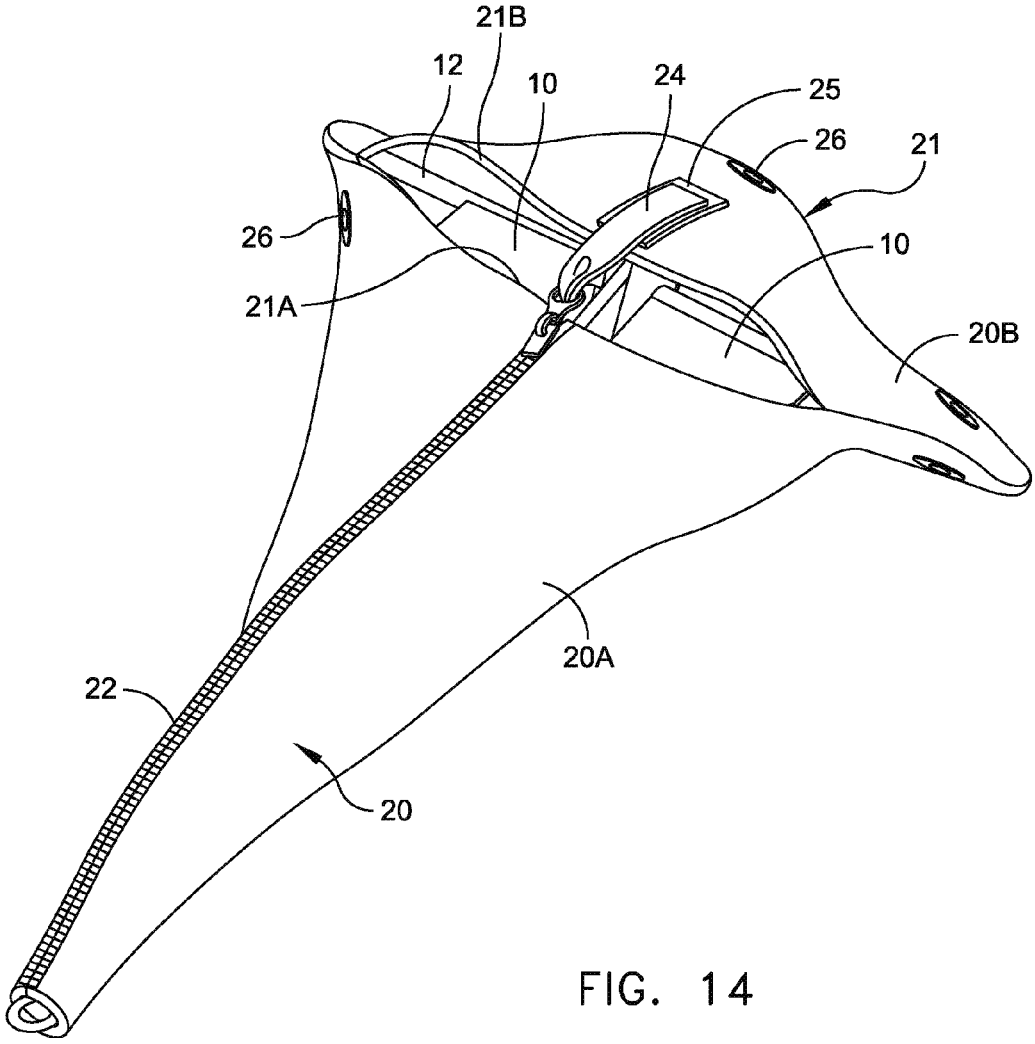
FIG. 14 is a perspective view illustrating the anchor completely encased in the anchor cover.

The drawings also illustrate, such as in FIG. 1, the cover 20. The cover 20 may be constructed of a rubber-type material such as neoprene and is provided with a longitudinally extending zipper 22. The zipper 22 provides an access means that enables the anchor to be disposed within the cover. Other access means (opening and closing member) may also be provided such as a series of buttons or other fasteners such as hook and loop fasteners. The access means preferably extends longitudinally of the cover regardless of the type thereof. With regard to the disclosed embodiment the zipper 22 is shown in a substantially closed position in FIGS. 1 and 14. In the position illustrated in FIG. 14 wherein the entire fluke anchor is encapsulated by the cover, it is noted that the zipper 22 is also provided with an end piece 24 so that the movable part of the zipper can be attached to the end piece 24 thus assuring that the cover is in a substantially completely closed condition. The end piece 24 may comprise a velcro strip that can be attached to the cover pad 25. This velcro arrangement enables easy attachment and detachment of the end of the zipper to maintain the cover in a closed position. In an alternate embodiment the end piece may be replaced by a strap and releasably buckle in which the ends of the strap are attached respectively at the zipper and at a location where the pad 25 is shown in FIG. 14

Figure 9:
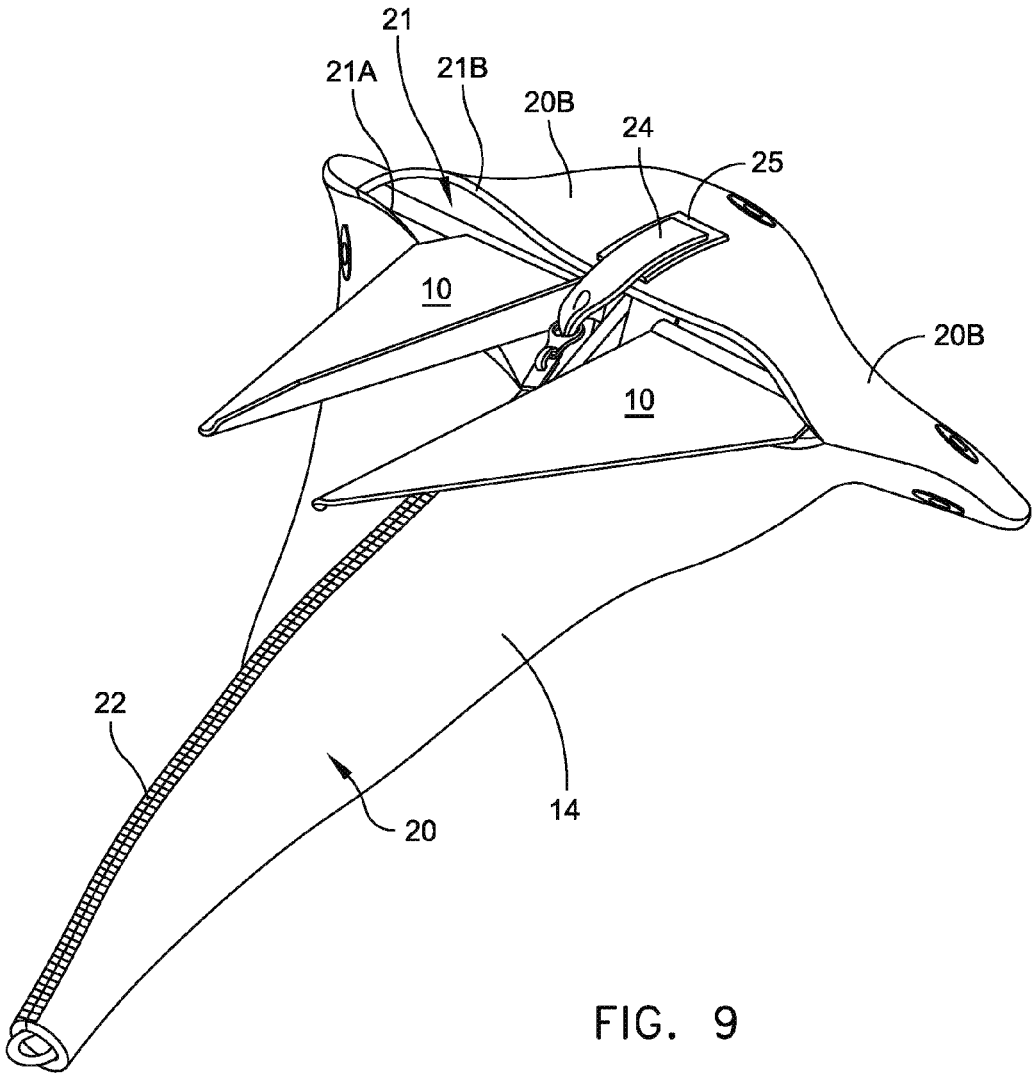
FIG. 9 is a perspective view similar to that shown in FIG. 8 but with the flukes of the anchor exposed.
Figure 10:
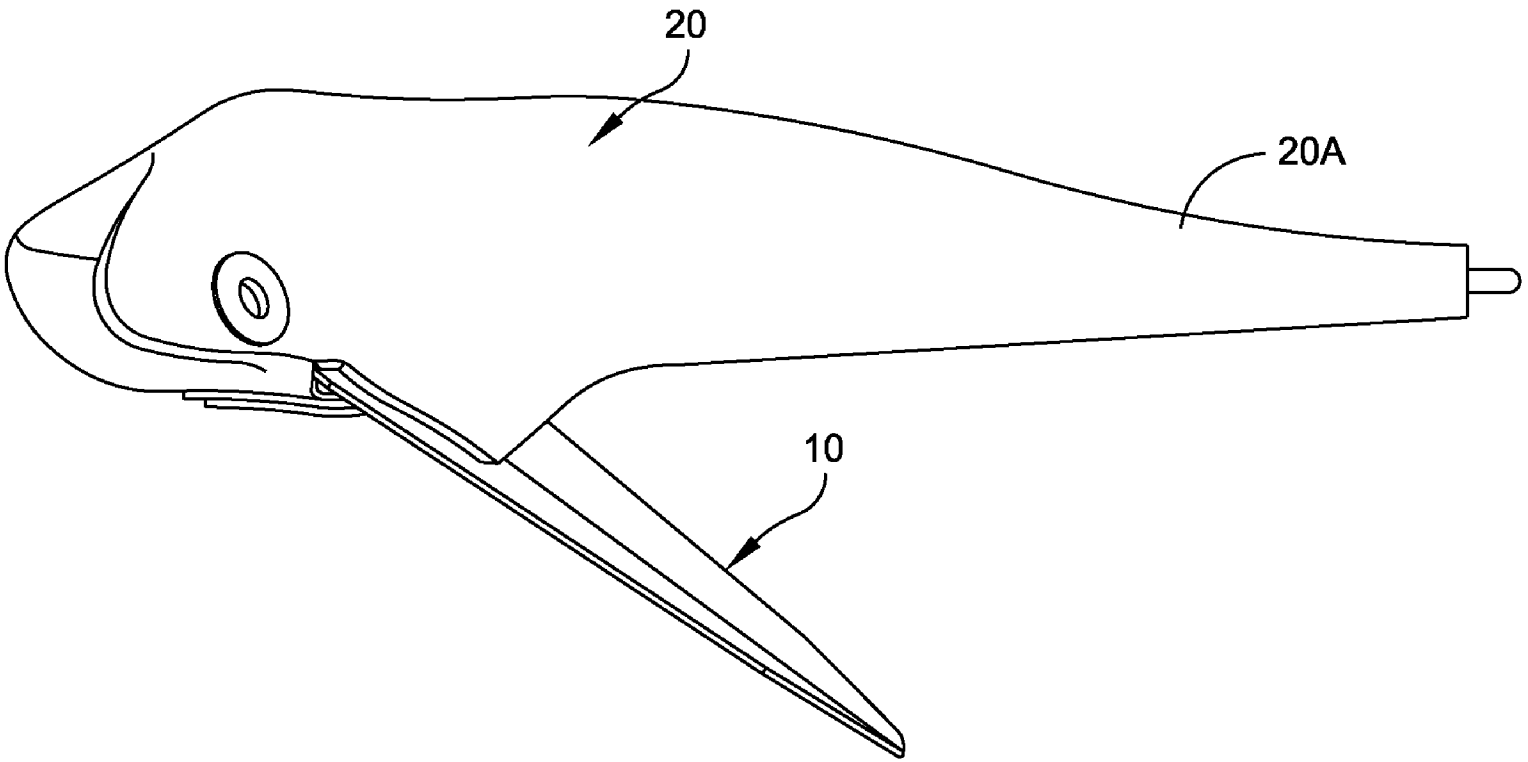
FIG. 10 is a side elevation view of the anchor and anchor cover.

The cover 20 may be considered as including a rather elongated and tapered portion 20A and side extending cover wings 20B. The cover may also be provided with spaced holes 26 that would allow any water that may accumulate in the cover to be discharged from the cover. In FIGS. 1 and 14 multiple holes 26 are shown. Preferably at least two holes are provided and may be provided on the back surface of cover at the location of the wings. Refer also to FIGS. 9 and 14 where, when the zipper 22 is closed, an opening 21 is formed essentially between a top edge 21A of the tapered portion 20A and edge 21B of the wing portion 20B. Refer to FIG. 14 for an illustration of edges 21A and 21B, as well as the opening 21. FIG. 9 shows the main part of the anchor encased but with the flukes 10 exposed through the opening 21. FIG. 14 shows all of the anchor encased but with the opening 21 still exposed. In both views the end piece strap 24 is secured. Thus, even in the closed or mostly closed position of the zipper 22, one may still be able to insert or remove the anchor through the opening 21. Preferably the zipper is at least partially opened to insert the anchor.

Figure 3:
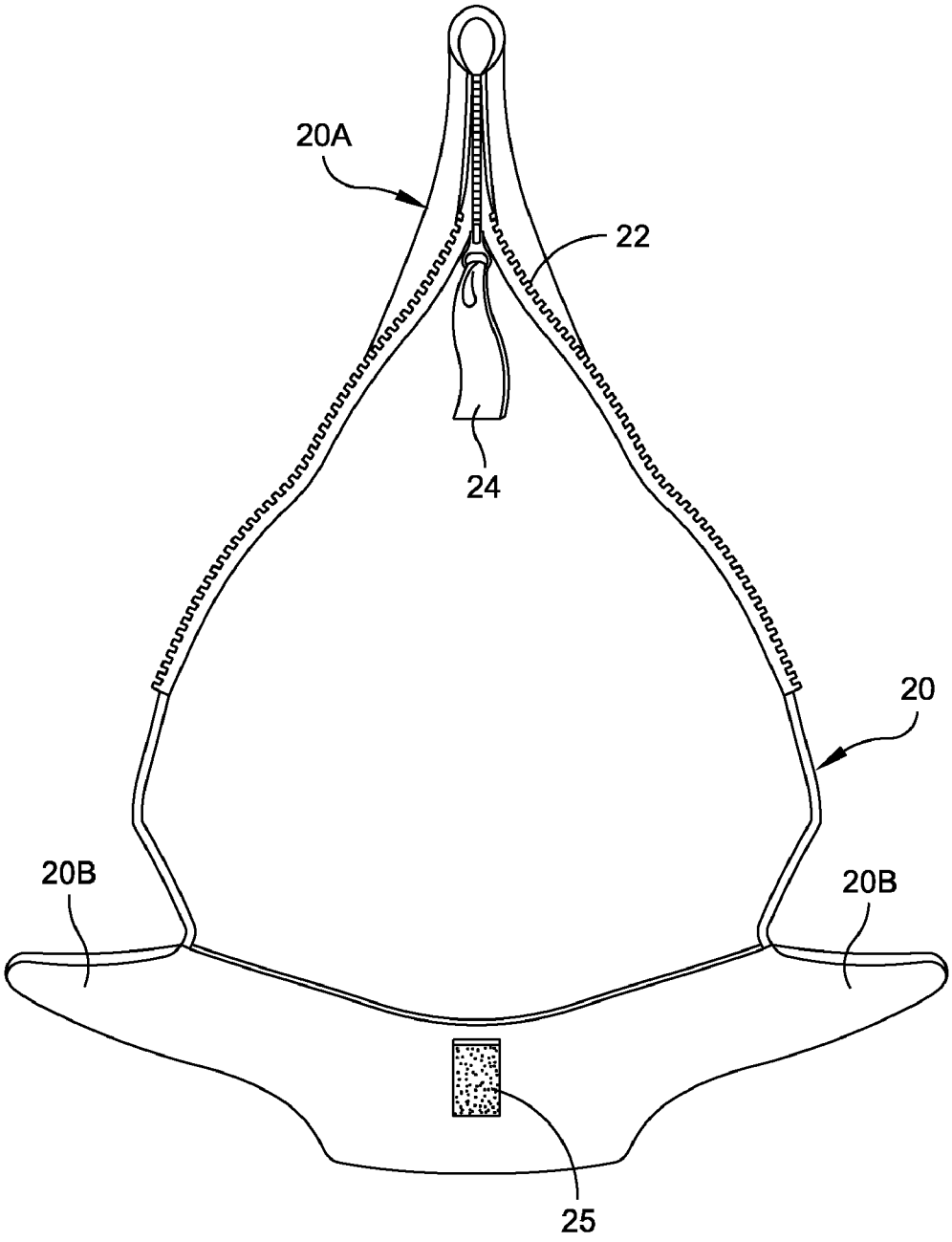
FIG. 3 is a plan view of the anchor cover.
Figure 4:
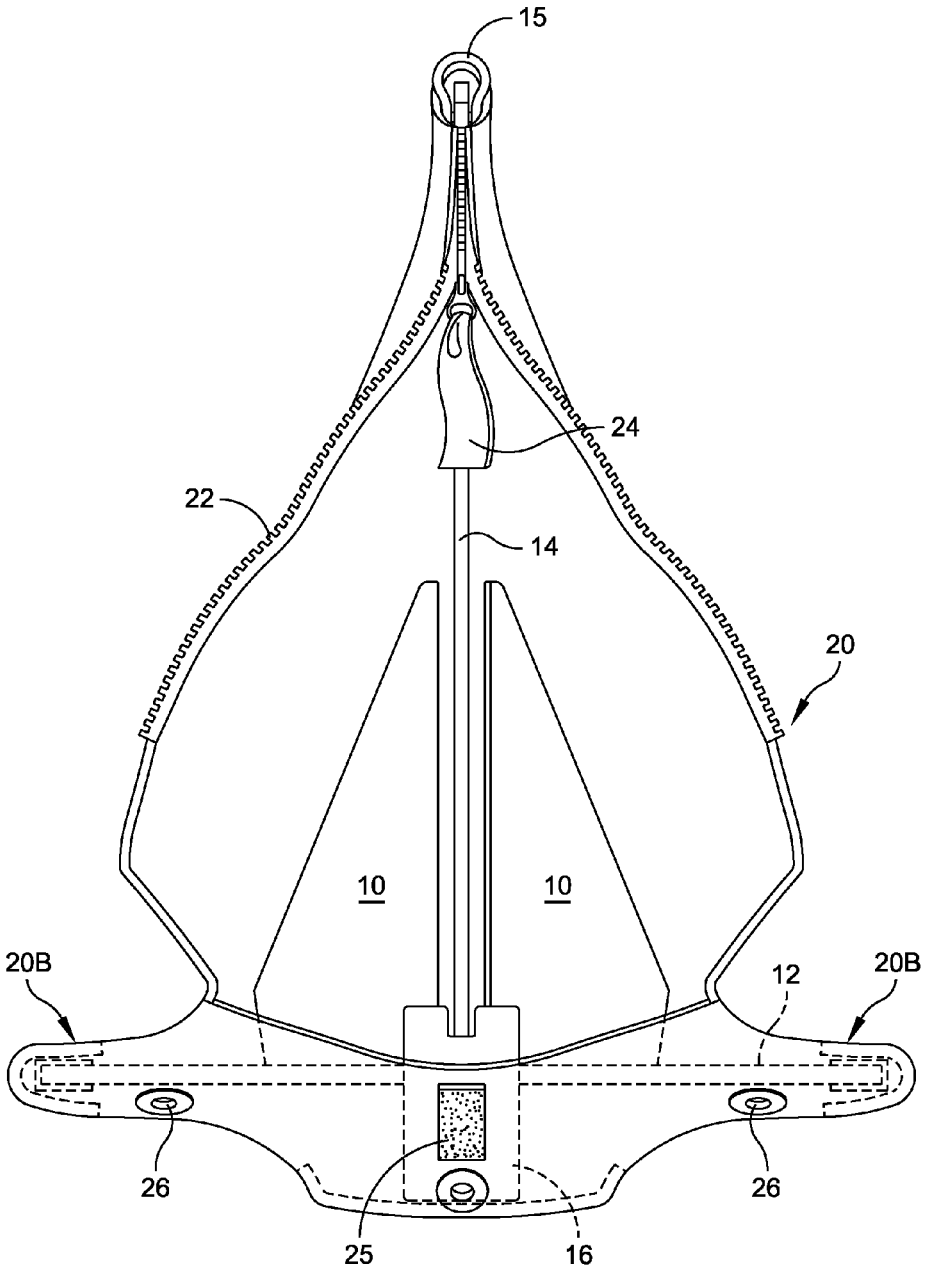
FIG. 4 is a plan view of the anchor cover with the anchor within the cover.
Figure 5:
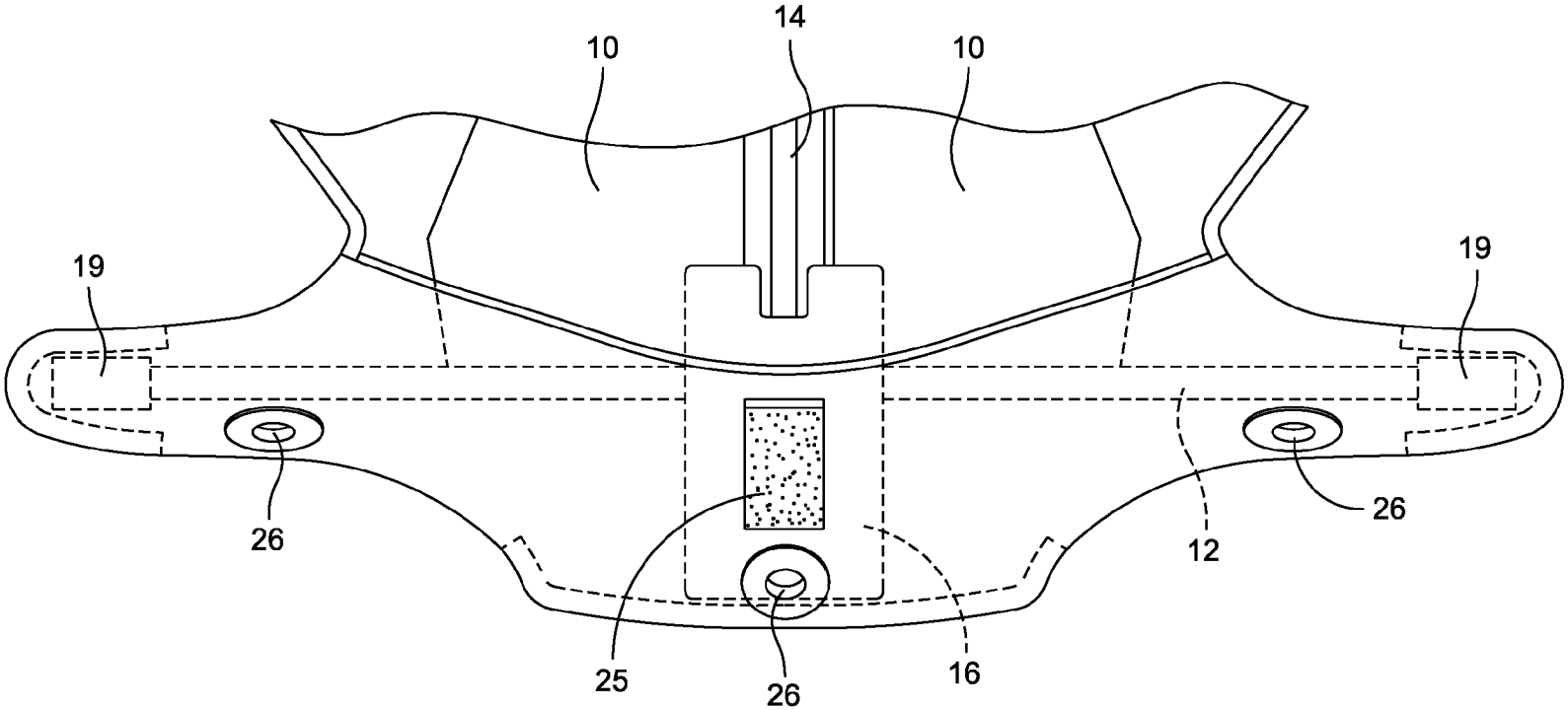
FIG. 5 is an enlarged fragmentary view.
Figure 6:
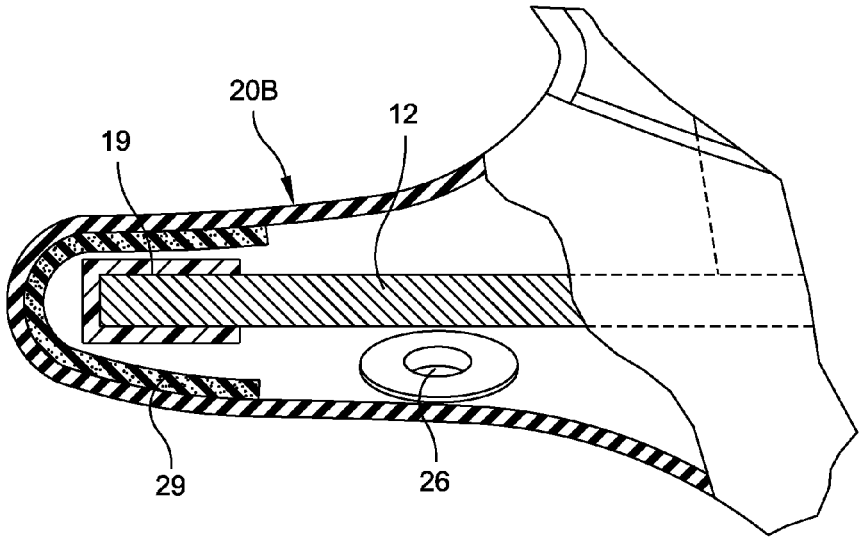
FIG. 6 is a fragmentary cross-sectional view.
Figure 7:
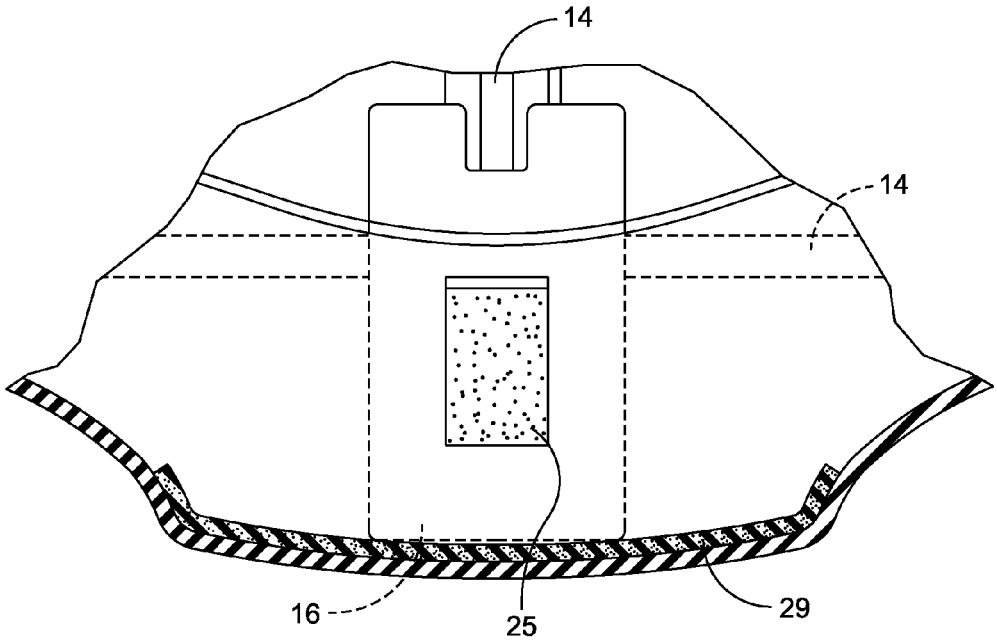
FIG. 7 is a further fragmentary cross-sectional view.

Refer also now to FIGS. 3 and 4 which illustrate the cover in an open position. FIG. 3 illustrates the cover alone while FIG. 4 illustrates the fluke anchor arranged within the cover but before the cover is closed. The elongated arm 14 extends so that its end loop 15 may extend through a very end hole in the cover. The rod 12 is disposed, so that opposite ends of the rod are received within the wings 20B of the cover. As also illustrated in the cross-sectional view of FIG. 6, these end wings are preferably also provided with a buffer material such as a foam layer 29 to provide some additional protection for the ends of the rods so that they do not pierce through the cover. A foam material 29 may also be provided for cushioning the piece 16.

Figure 8:
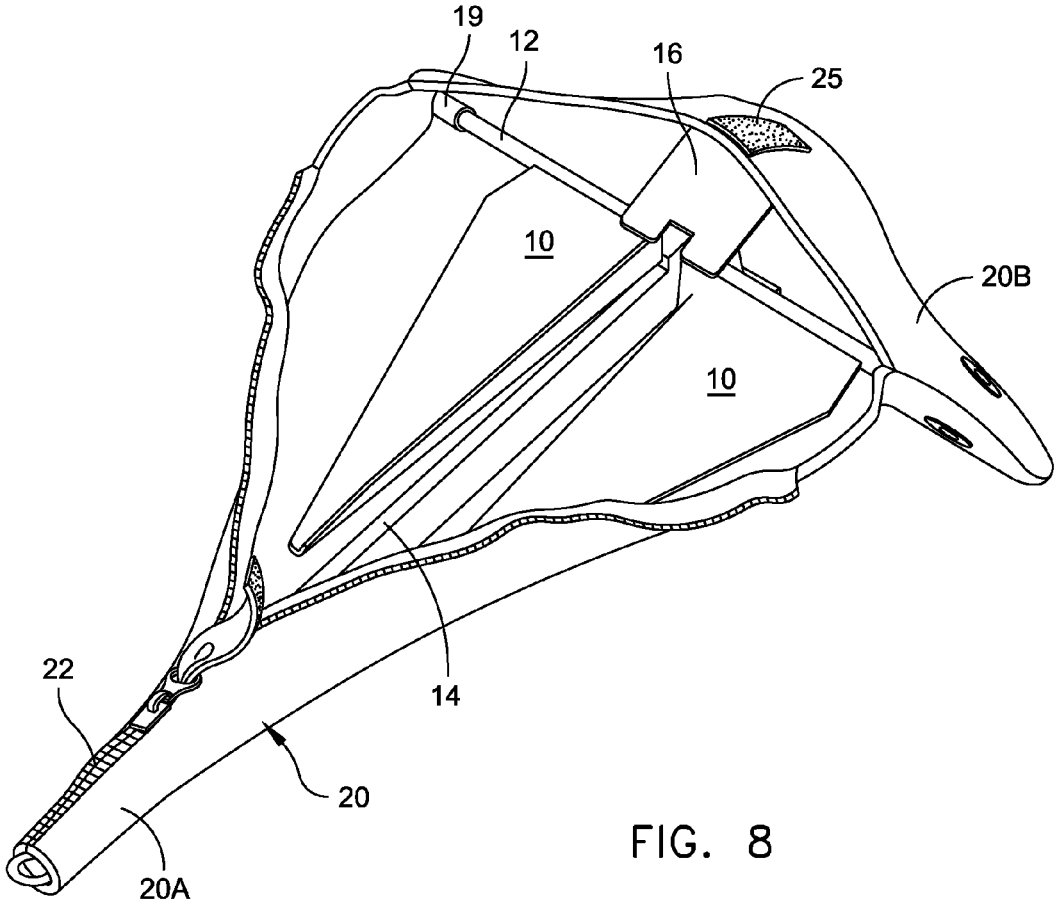
FIG. 8 is a perspective view with the anchor in place and the cover open.

FIG. 8 illustrates the cover 20 in a partially closed position with the flukes pivoted downwardly. FIG. 14 illustrates the full closed position in which the flukes are under the cover and thus the cover provides a safe arrangement with no substantial sharp edges or points of the fluke anchor being exposed.

Figure 11:
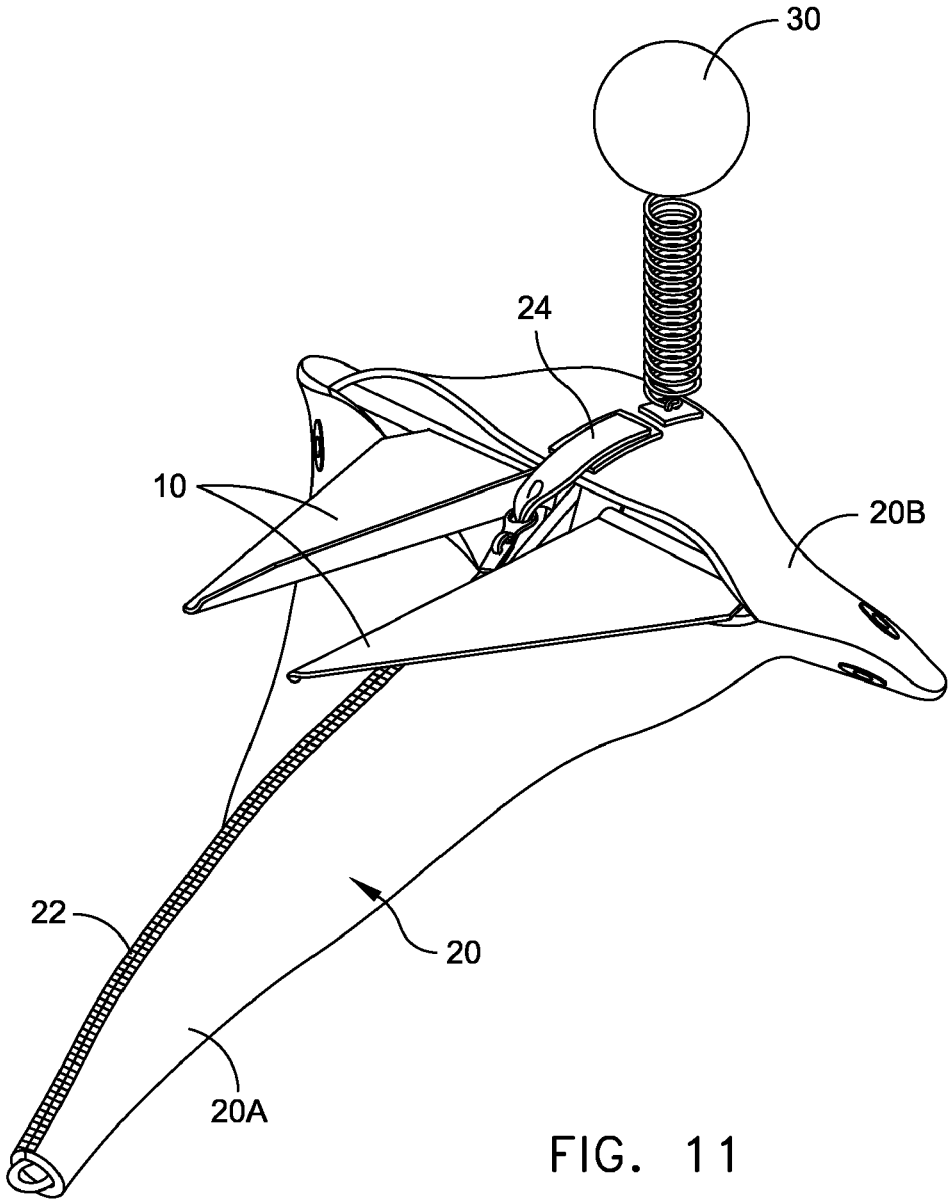
FIG. 11 is a perspective view similar to that shown in FIG. 9 further using an indicator ball.
Figure 13:
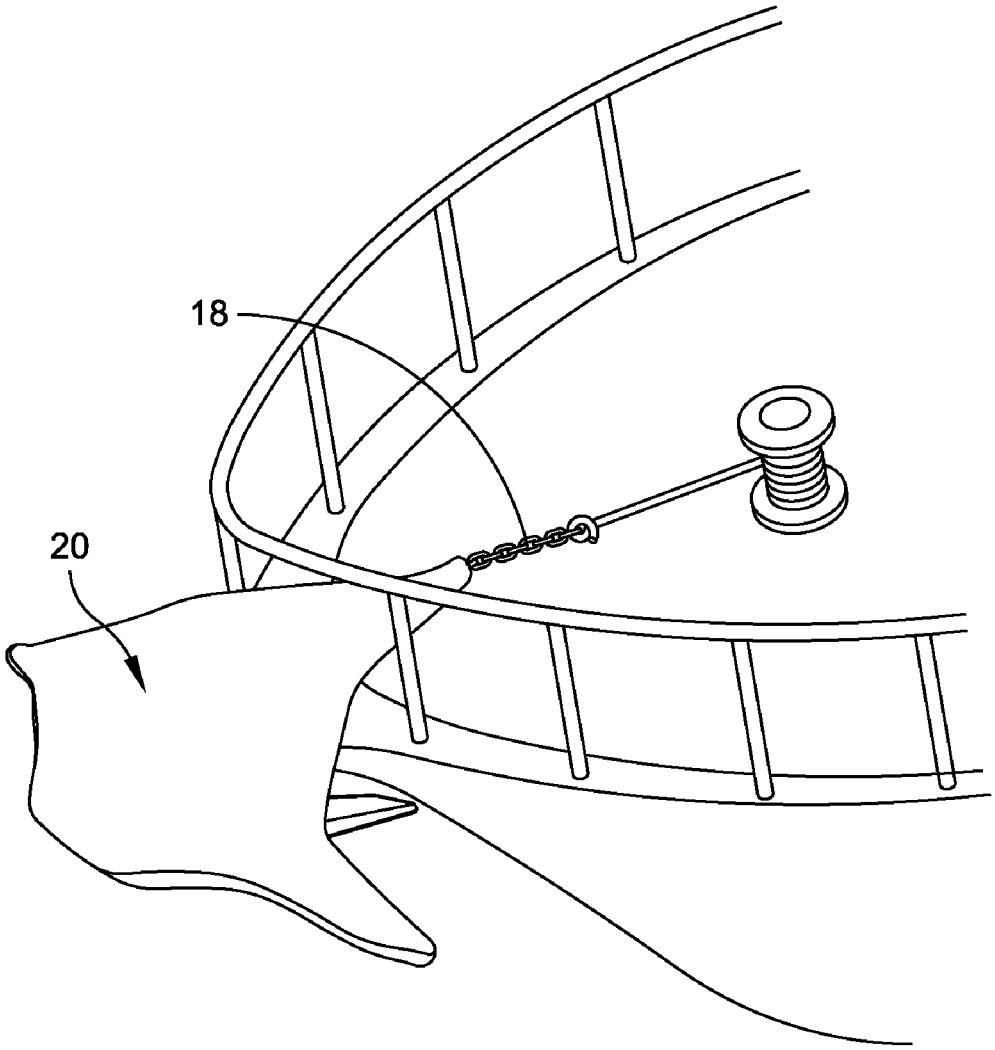
FIG. 13 illustrates the anchor cover in use on the anchor.

Another feature of the present invention is illustrated in FIGS. 11 and 12. This includes a flotation or indicator ball 30 that is constructed of a lightweight material and that is adapted to be able to float. In this regard, refer to the side elevation view of FIG. 12 that illustrates the ball 30 floating upon a water surface 31. The ball 30 is preferably attached to the cover by means of a tether 32. The tether 32 is preferably expandable so that the ball can be extended to different lengths from the cover 20. Thus, for example, if the anchor is set in the sand as illustrated in FIG. 12 and then the tide comes in, one can still mark the location of the cover and anchor. Moreover, the cover of the present invention can be used in the position shown in FIG. 14 where it can be stowed in a number of different ways upon a vessel. One way is illustrated in FIG. 13.

Figure 15:
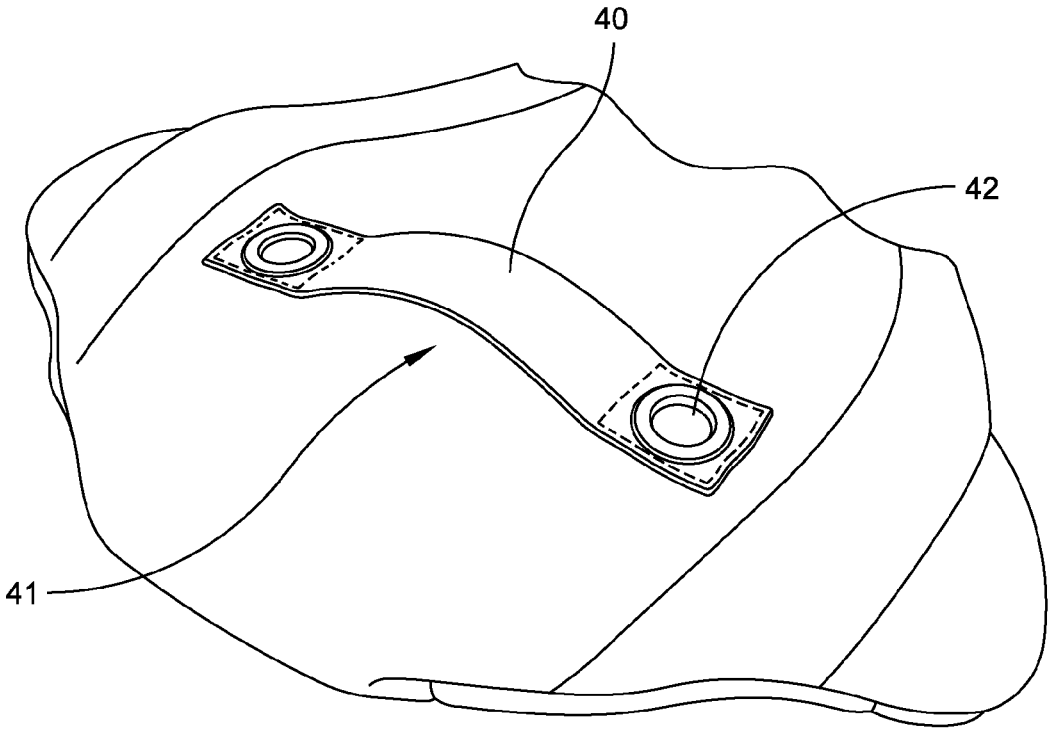
FIG. 15 is a fragmentary perspective view of a modification to the first embodiment.
Figure 16:
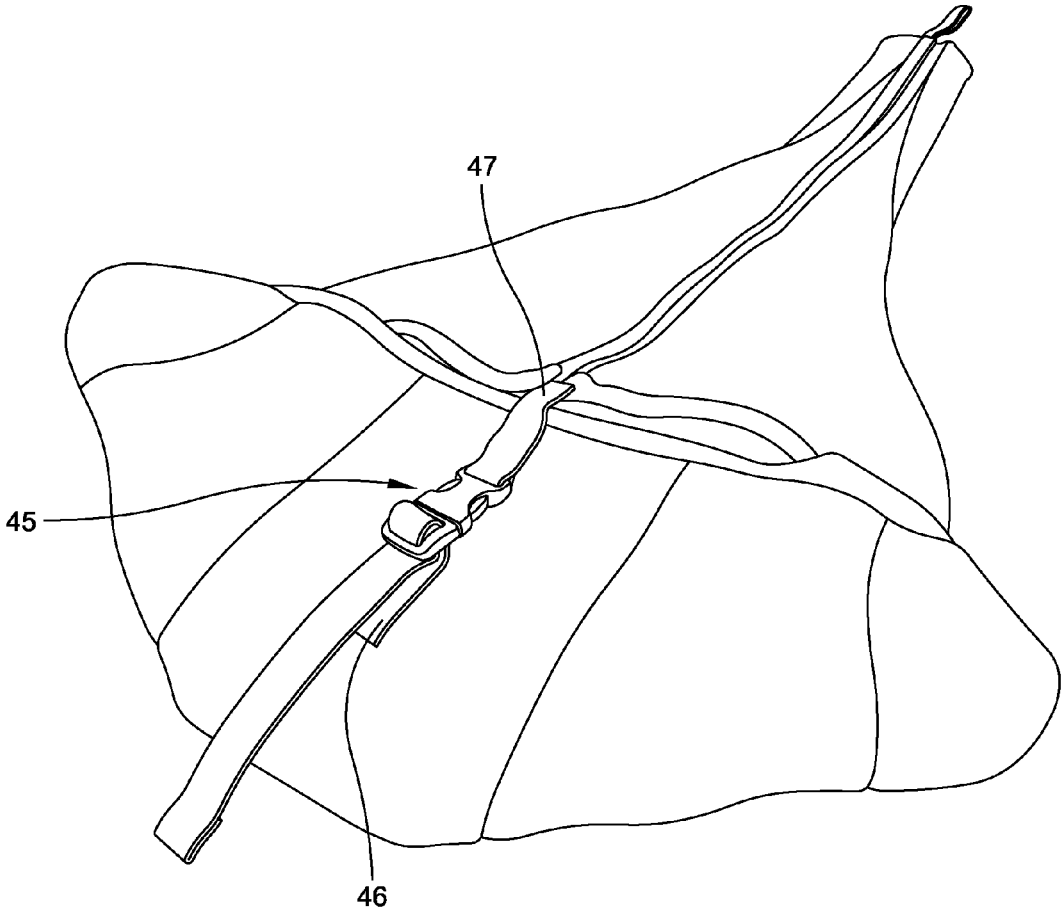
FIG. 16 is a fragmentary perspective view showing an alternate arrangement for fastening.
Figure 17:
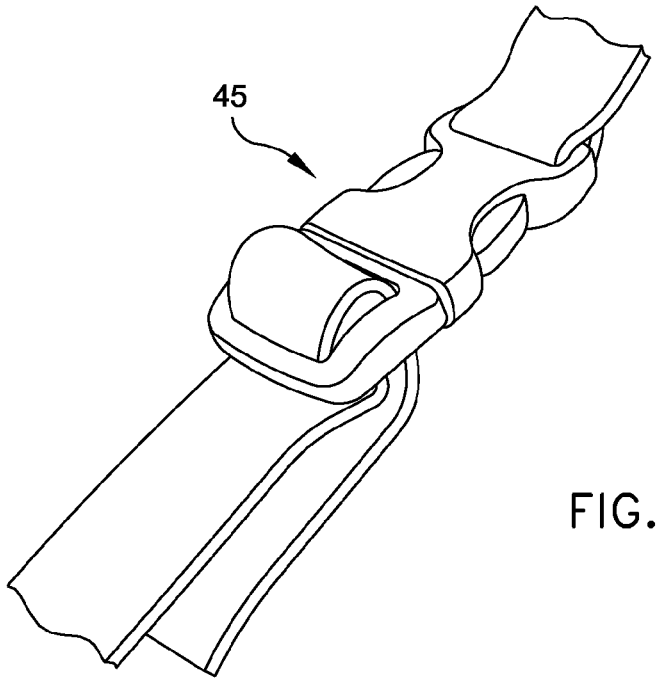
FIG. 17 is a fragmentary perspective view of the buckle construction.
Figure 18:
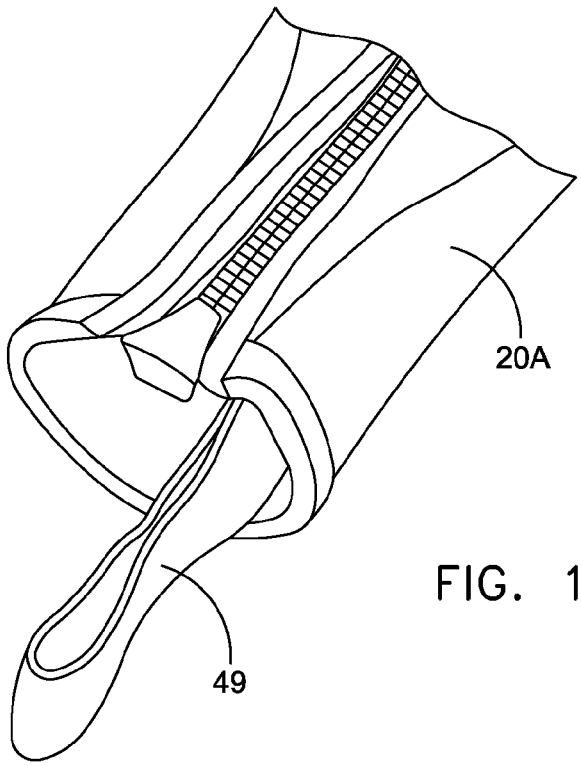
FIG. 18 is a fragmentary perspective view showing a further modification with a hanging strap.

FIG. 15 illustrates a modification to the first embodiment wherein at the rear surface of the cover there is provided a strap 40 that forms an open loop 41. In that way the strap 40 can be used as a handle for carrying the anchor cover. The ends of the strap 40 are secured by grommets 42 that, not only secure the strap to the anchor cover material but also provide open ports for the discharge of any water that may accumulate in the anchor cover. FIG. 16 also shows an alternate buckle construction at 45. Refer also to the fragmentary perspective view of FIG. 17. The buckle construction can be of conventional design rather than using velcro attachments. Ends of the buckle strap may be secured on one side at 46 such as by being stitched to the fabric of the cover. The other end at 47 may be secured to the zipper pull tab. FIG. 18 illustrates the use of a securing or holding strap 49 that would be attached inside of the cover adjacent to the zipper and at the very distal end of the section 20A.

Figure 19:
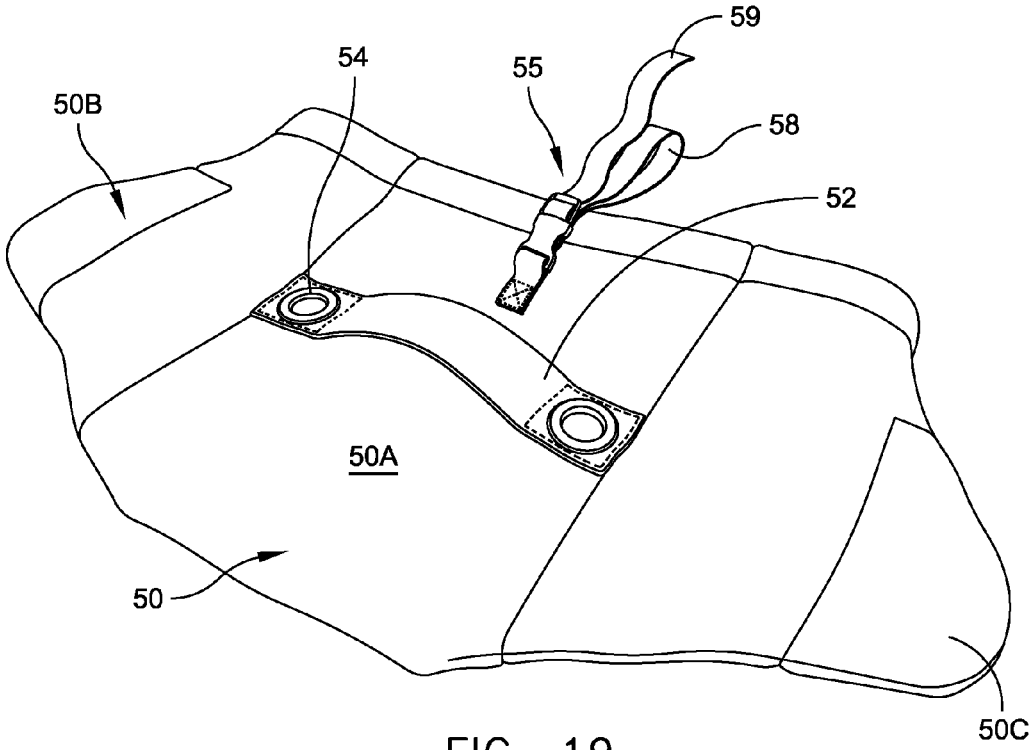
FIG. 19 is a perspective view of still another embodiment of the present invention referred to as a "anchor vest;"
Figure 20:
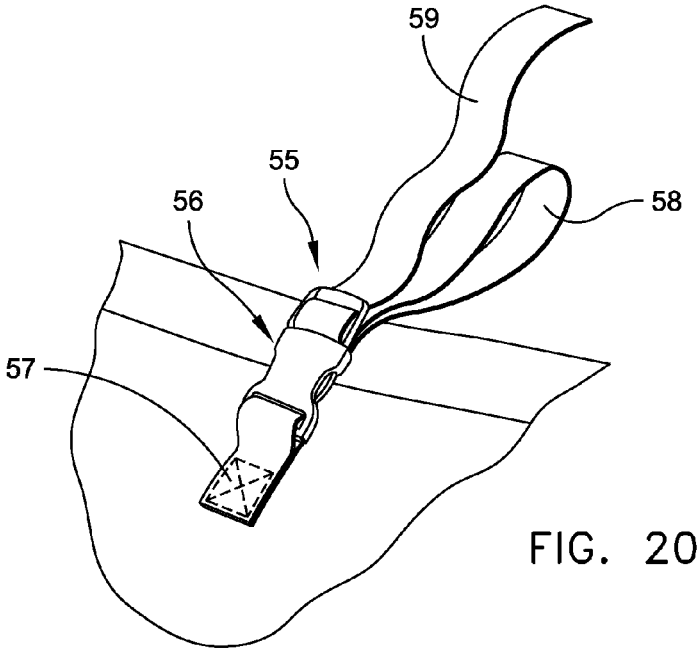
FIG. 20 is a fragmentary perspective view illustrating the securing strap.

Reference is now made to a further embodiment of the present invention illustrated in FIGS. 19-20. This may be referred to as an anchor vest 50. This anchor vest may be constructed of the same material as previously described in connection with the first embodiment that is disclosed herein. Thus, the anchor cover 50 includes a central section 50A and side wing sections 50B and 50C. As illustrated in FIG. 19, the front side of the cover includes a strap 52 secured by grommets 54 and essentially of the same construction as previously described in connection with FIG. 15. This provides a carrying strap and the grommets 54 are open so as to allow some drainage from the cover. FIG. 19 also illustrates the strap and buckle arrangement at 55. Refer also to the fragmentary perspective view of FIG. 20. The buckle and strap arrangement 55 includes the conventional two-piece buckle 56 and a strap that includes one end 57 that secures the strap to the cover material. Another section of the strap is also secured at the same place to form a loop 58. There is also a free end 59 of the strap that is usable for securing the vest around another item that is found on the vessel.

Figure 21:
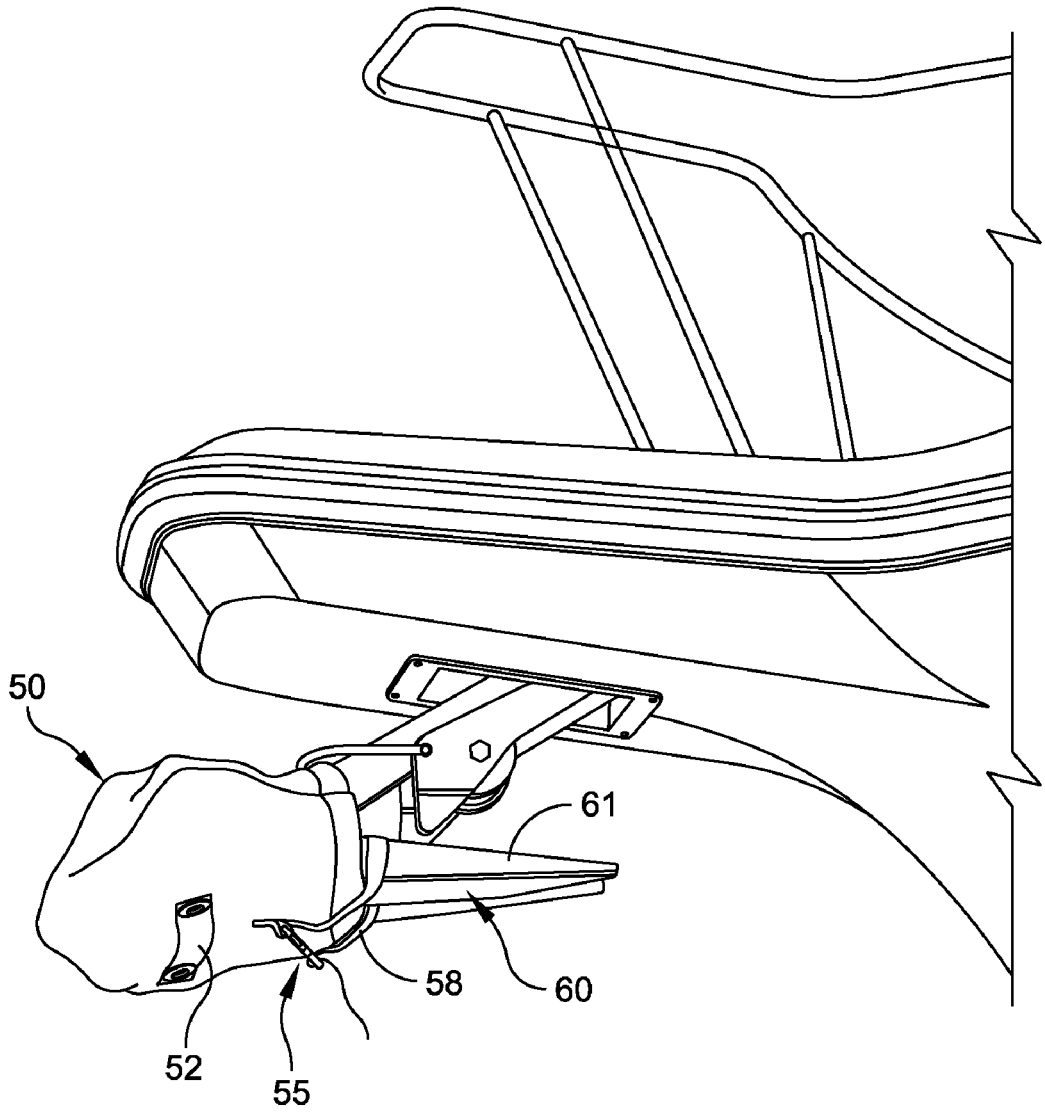
FIG. 21 is a perspective view illustrating the manner in which the anchor vest is used over an anchor.

Reference may now be made to FIG. 21 for an illustration of the cover 50 as positioned over the anchor 60. The buckle and strap construction 55 is illustrated with the loop 58 secured about the tines 61 of the anchor. Thus, the buckle and strap arrangement can be used for retaining the anchor cover on at least a portion of the anchor to prevent damage.

Figure 22:
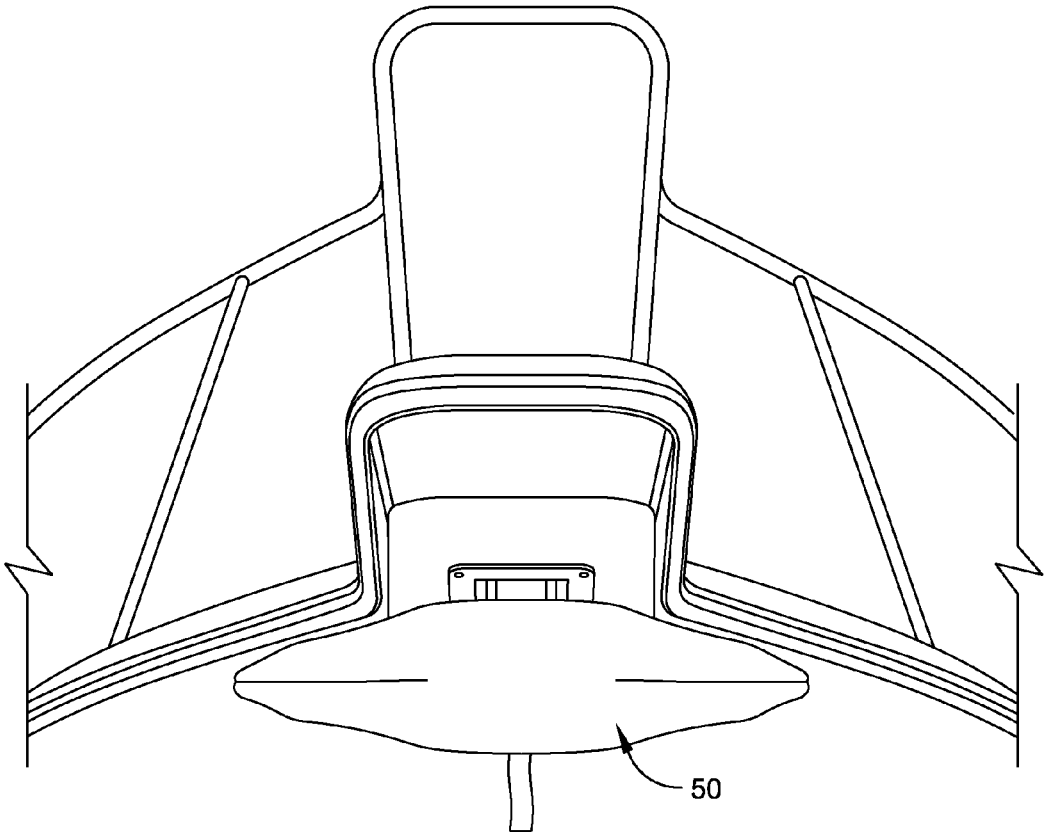
FIG. 22 is a front view of the anchor vest showing the anchor on a roller in the stowed position.
Figure 23:
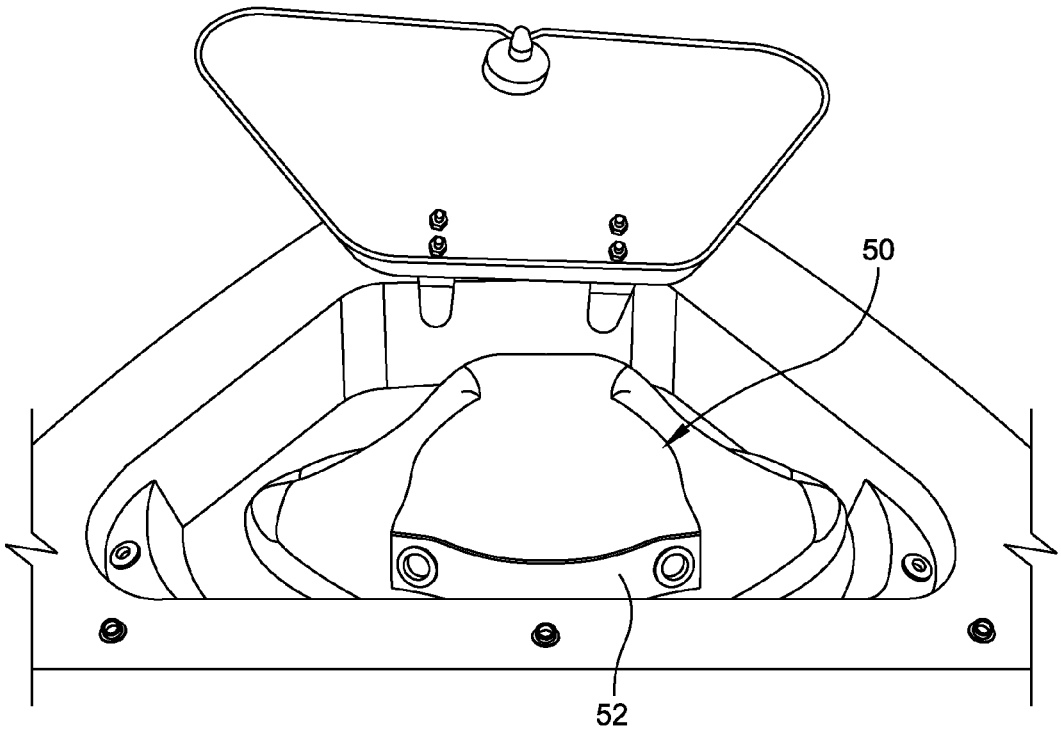
FIG. 23 is a top view of the anchor vest showing the anchor vest stowed in the pulpit located in the bow of the boat.

FIG. 22 schematically illustrates the anchor cover on the roller in the stowed position on the vessel. FIG. 23 illustrates the anchor cover 50 in the pulpit located in the bow of the boat in a stowed position.

Figure 24:
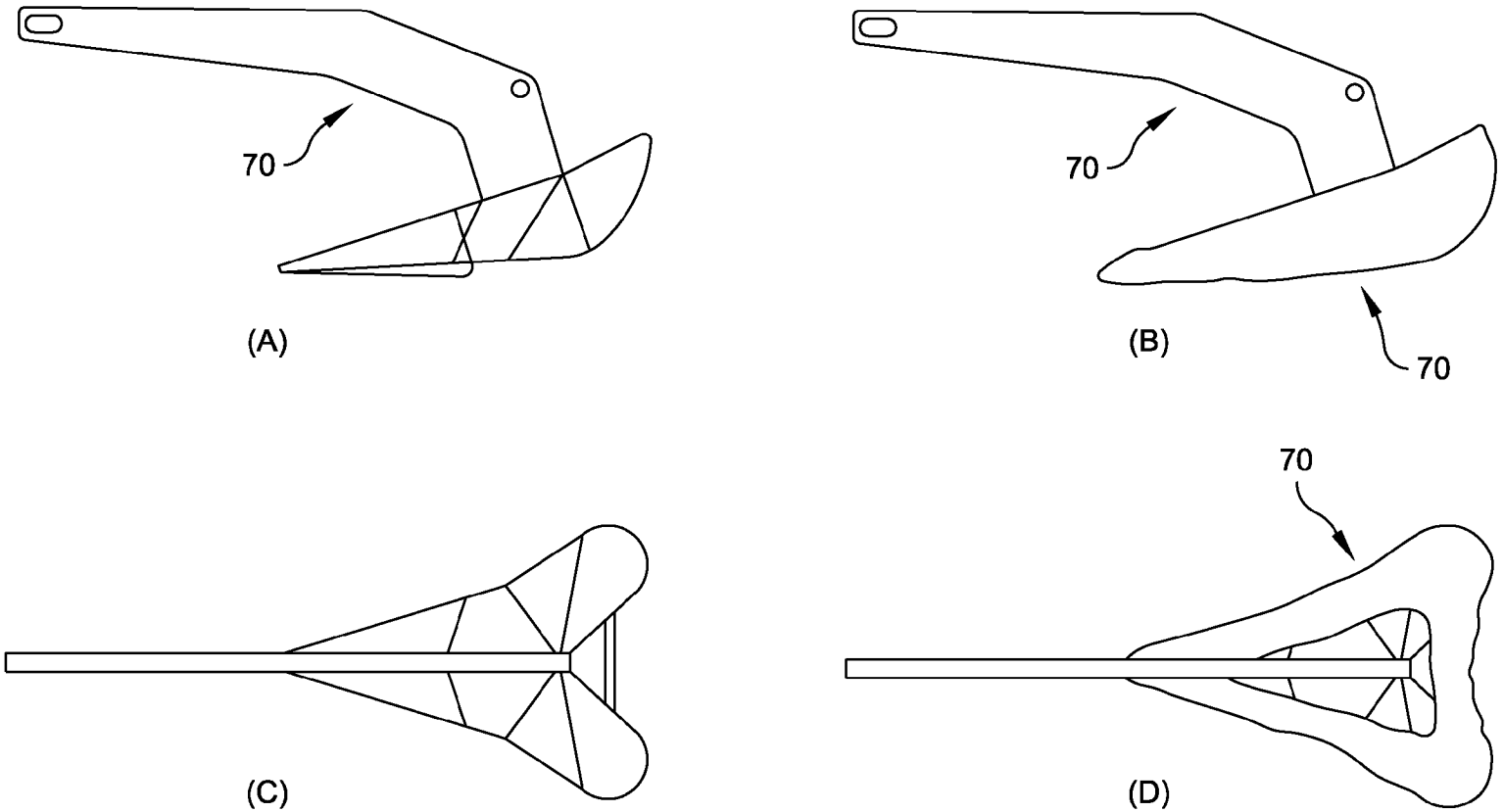
FIG. 24 illustrates the anchor cover of the present invention as it may be used with a different design anchor such as a "delta" anchor.
Figure 25:
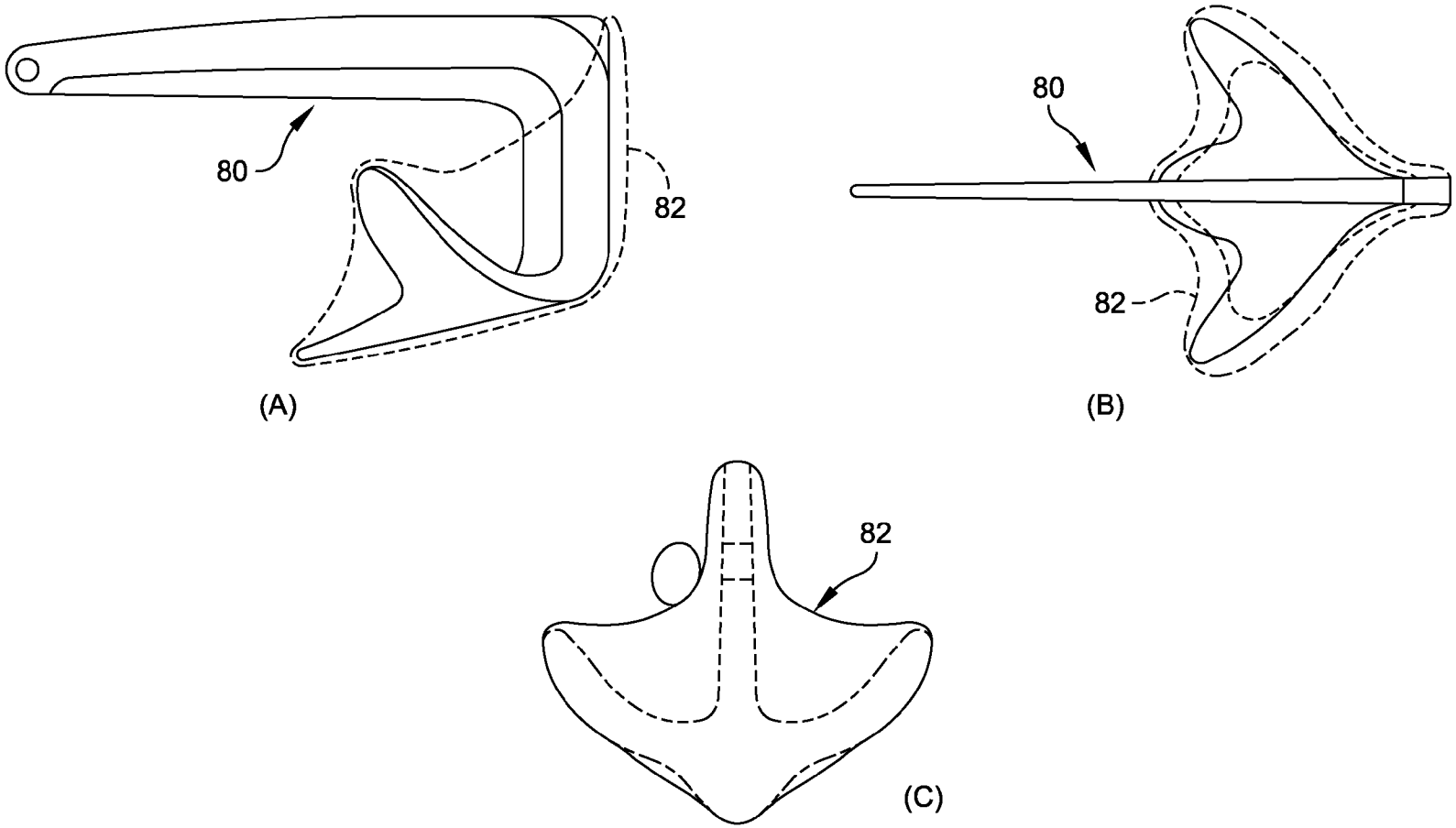
FIG. 25 are a series of schematic diagrams illustrating the anchor cover of the present invention as may be used with a "bruce" anchor.

Reference is now made to schematic diagrams found in FIGS. 24 and 25. FIG. 24 illustrates a "delta" anchor 70. FIGS. 24A and B illustrate a side view while FIGS. 24C and D illustrate a top view. FIGS. 24A and C illustrate the configuration of the "delta" anchor while FIGS. 24B and D show the anchor cover at 70. Like the first embodiment described herein, the anchor cover will also have a center section, a tapered elongated section and side wings substantially in the same manner as described in connection with the first embodiment herein.

FIG. 25 is an illustration of the use of the anchor cover of the present invention with a "bruce" anchor. FIG. 25A is a side view; FIG. 25B is a top view and FIG. 25C is a front view. The anchor is shown at 80 and the anchor cover is shown at 82. This anchor cover is illustrated in FIGS. 25A and B in dotted outline. As with the embodiment of FIG. 24, this embodiment of the invention also includes a center section and side wings.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A cover in combination with an anchor, said anchor including a support rod and a pair of flukes mounted from the support rod, said cover comprising a cover material of a resilient rubber material that includes an elongated bottom portion and a top portion having side wings, an elongated opening and closing member having open and closed positions and that enables the cover to be opened and closed for receipt of an anchor therein;

said elongated section including an elongated tapered portion having a longitudinal axis and the side wings including a pair of side extending wings that are integral with the tapered portion, and that define with the elongated tapered portion, in the closed position, an opening that extends transverse to the longitudinal axis;

said side extending wings extending transverse to and outwardly beyond the elongated tapered portion in both the open and closed positions of the elongated opening and closing member;

said opening defined by an elongated free top edge of the elongated tapered portion and an elongated free bottom edge of the top portion, said opening providing access to said anchor.

2. The cover of claim 1 wherein the cover material is neoprene.

3. The cover of claim 1 including a strap means for maintaining the opening and closing member in a closed position and releasable secured between the opening and closing member and the top portion.

4. The cover of claim 3 wherein the opening and closing member comprises a zipper that extends longitudinally along the longitudinal axis through the tapered portion, and includes a fixed zipper portion and a closing tab for slidingly opening or closing the zipper portion, said strap including an end piece secured to the closing tab at one end thereof and having the other end thereof releasably secured to the top portion of the cover.

5. The cover of claim 4 wherein the tapered portion encloses the anchor with an end hole, in alignment with the longitudinal axis, for receiving an end loop of the anchor.

6. The cover of claim 5 wherein ends of a rod of the anchor are accommodated in the respective pair of side extending wings.

7. The cover of claim 6 wherein each side extending wing has an inner protective buffer layer.

8. The cover of claim 6 wherein the top portion has at least one hole to allow any water accumulated in the cover to be discharged from the cover.

9. The cover of claim 1 including a floatation piece attached to the cover.

10. The cover of claim 9 wherein the floatation piece includes a floatation ball and including a tether to attach the floatation ball to the cover.

11. The cover of claim 10 wherein the tether is expandable.

12. A protective cover in combination with a boat anchor, said anchor including a support rod and a pair of flukes mounted from the support rod, said protective cover comprising:

a cover that is constructed of a resilient rubber or cloth material and that is arranged for receipt of at least a portion of the anchor;

said cover including an elongated section and side wings;

said elongated section includes an elongated tapered portion having a longitudinal axis and the side wings include a pair of side extending wings that are integral with the tapered portion, and that define with the elongated tapered portion an opening;

an access means including an elongated closure device that extends longitudinally of the tapered portion for receipt of the anchor therein;

said elongated closure device having open and closed positions;

said closure device comprising a zipper;

said side extending wings extending transverse to and outwardly beyond the elongated tapered portion in both the open and closed positions of the zipper;

said opening defined by an elongated free top edge of the elongated tapered portion and an elongated free bottom edge of the top portion, said opening providing access to said anchor.

13. The cover of claim 12 including a strap means for maintaining the zipper in a closed position and releasably secured between the zipper and a top portion defined by the side wings.

14. The cover of claim 13 wherein the tapered portion encloses the anchor with an end hole in line with the longitudinal axis and for receiving an end loop of the anchor, and the zipper includes fixed zipper portion and a closing tab for slidingly opening or closing the zipper portion, said strap including an end piece secured to the closing tab at one end thereof and having the other end thereof releasably secured to the top portion of the cover.

15. The cover of claim 14 wherein said strap means includes a hook and loop fastener for releasably attachment of the strap means at the top portion.

16. The cover of claim 15 wherein the strap means extends across the opening to separate the opening into respective adjacent passages, and wherein the anchor includes a pair of flukes that extend through the respective passages.

17. The cover of claim 12 wherein the tapered portion encloses the anchor with an end hole in line with the longitudinal axis and the top portion has spaced holes to allow any water accumulated in the cover to be discharged from the cover.

18. The cover of claim 12 including a floatation piece attached to the cover.

19. The cover of claim 18 wherein the floatation piece includes a floatation ball and including a tether to attach the floatation ball to the cover.

20. The cover of claim 19 wherein the tether is expandable.

* * * * *